US006253950B1

(12) United States Patent
Buck et al.

(10) Patent No.: US 6,253,950 B1
(45) **Date of Patent: *Jul. 3, 2001**

(54) FLOATING COOLER

(76) Inventors: Ronald Buck, 6125 Little Creek Ct., Huber Heights, OH (US) 45424; Michael A. Blanford, 546 Ramsgate Dr., Beavercreek, OH (US) 45430; Wesely Campbell, 5916 Woodmore Dr., Dayton, OH (US) 45414

( * ) Notice: Subject to any disclaimer, the term of this patent is extended or adjusted under 35 U.S.C. 154(b) by 0 days.

This patent is subject to a terminal disclaimer.

(21) Appl. No.: 09/349,891

(22) Filed: Jul. 8, 1999

(51) Int. Cl.[7] ..... B65D 81/38

(52) U.S. Cl. ..... 220/560; 4/496; 220/592.15; 446/153

(58) Field of Search ..... 220/560, 592.03, 220/915.1, 915.2, 903, 789, 592.15; 4/496; 441/40–43, 129, 130; 446/153, 156

(56) References Cited

U.S. PATENT DOCUMENTS

| | | | | |
|---|---|---|---|---|
| D. 176,107 | * | 11/1955 | Carrick et al. | 27/115 |
| D. 217,685 | * | 5/1970 | Steffens | 21/603 |
| D. 316,734 | * | 5/1991 | Tak | 21/601 |
| D. 337,486 | * | 7/1993 | Maggiore | 7/606 |
| D. 423,295 | * | 4/2000 | Buck et al. | 7/606 |
| 2,540,756 | * | 2/1951 | Radcliffe | 220/592.03 |
| 2,645,332 | * | 7/1953 | Martin et al. | 220/915.1 |
| 3,791,547 | * | 2/1974 | Branscum | 220/408 |
| 4,043,368 | * | 8/1977 | Forte, Sr. | 220/287 |
| 4,870,837 | * | 10/1989 | Weins | 62/457.4 |
| 4,871,079 | | 10/1989 | Doucette et al. . | |
| 4,927,041 | | 5/1990 | Hepburn . | |
| 4,974,426 | * | 12/1990 | Gomez et al. | 62/457.7 |
| 5,299,588 | * | 4/1994 | MacLeod | 135/16 |
| 5,305,544 | | 4/1994 | Testa, Jr. . | |
| 5,403,095 | * | 4/1995 | Melk | 383/110 |
| 5,472,542 | * | 12/1995 | Wermund | 156/245 |
| 5,564,288 | | 10/1996 | Lewis . | |
| 5,740,951 | * | 4/1998 | Jack | 224/115 |
| 5,791,473 | * | 8/1998 | Decker et al. | 206/407 |
| 5,871,382 | * | 2/1999 | Foulke | 441/129 |
| 6,029,845 | * | 2/2000 | Mueller | 220/560 |
| 6,082,035 | * | 7/2000 | Groff | 43/2 |
| 6,085,926 | * | 7/2000 | Weiss | 220/23.86 |

* cited by examiner

*Primary Examiner*—Allan N. Shoap
*Assistant Examiner*—Joe Merek
(74) *Attorney, Agent, or Firm*—P. William Graham

(57) ABSTRACT

A floating cooler configured in accordance with a predetermined creature configuration is provided which includes a buoyant thermally insulated housing, the housing including a bottom portion, a side portion connected to the bottom portion and extending upward therefrom and forming an open enclosure therebetween, wherein the open enclosure defines a cavity and the housing includes an exterior configuration which is generally shaped as a portion of a torso characteristic of the predetermined creature. The cooler further includes a buoyant thermally insulated lid openably connected to the side portion in a manner to generally seal the open enclosure, wherein the lid includes an exterior configuration which is generally shaped as another portion of the torso which is characteristic of the predetermined creature and at least one buoyant appendage extending from the housing in a manner to aid in stabilization of the housing, wherein the appendage includes an exterior configuration which is generally shaped as an appendage characteristic of the predetermined creature.

12 Claims, 6 Drawing Sheets

Fig. 2
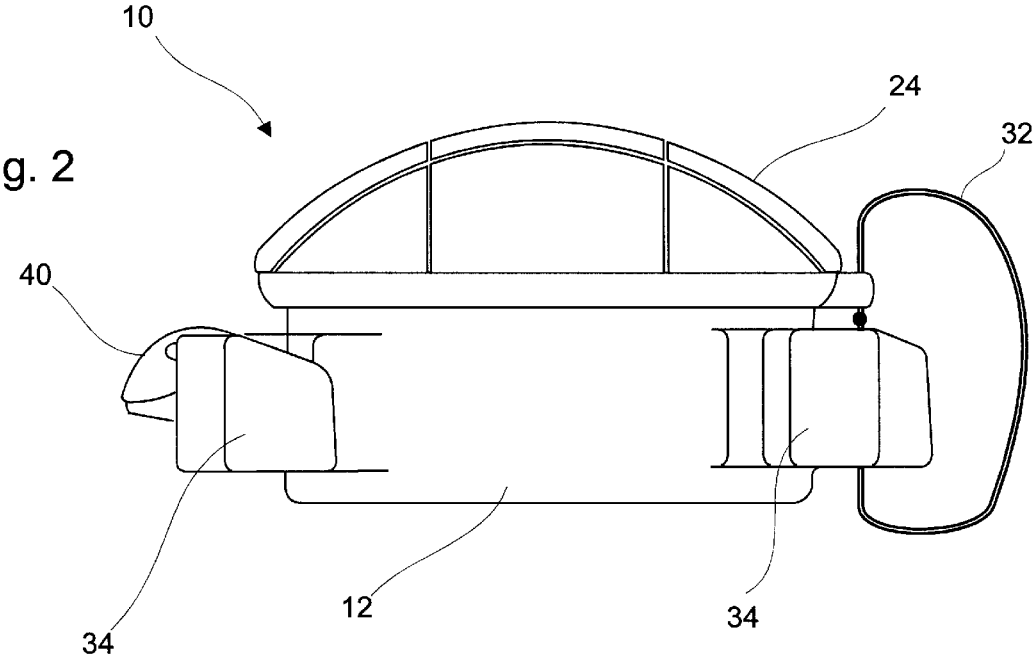
Fig. 4
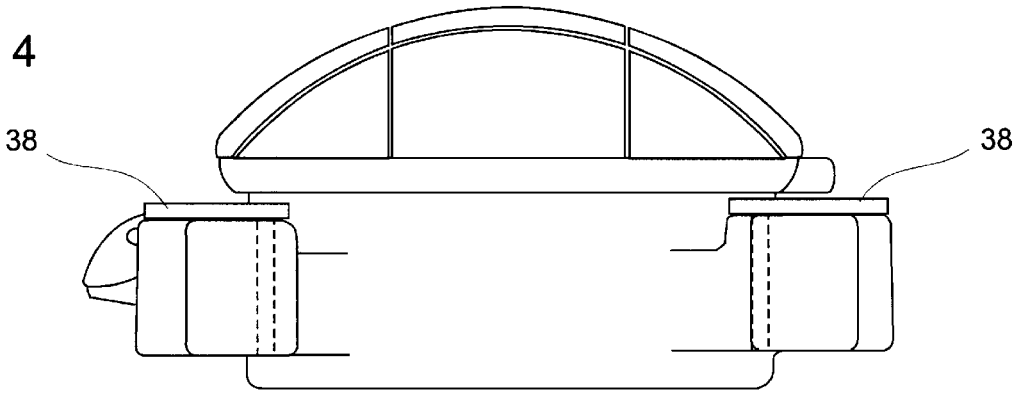
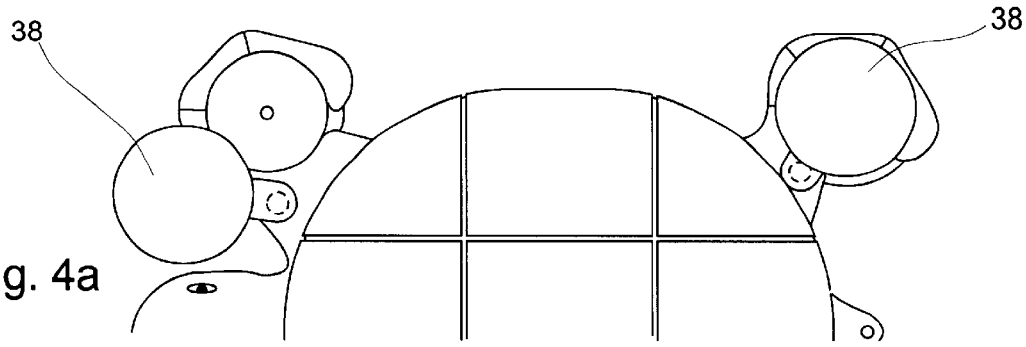
Fig. 4a

FLOATING COOLER

BACKGROUND OF THE INVENTION

1. Field of the Invention

The present invention relates generally to floating coolers. More particularly, the present invention relates to a floating cooler which is self stabilizing and in the form of an object, which can be a creature or a treasure chest, for example.

2. Related Art

There exist a number of types thermal insulated devices which have been used in water and maintain an upright position. For example, various floating rafts or water craft have integrated coolers into their structure. Still other coolers have been designed for use in connection with water craft as an "in-tow" cooler behind the craft under relatively rough water conditions.

While these coolers have met with some success, there remains a need for a floating cooler which is used in quiet and rough water conditions and provide an aesthetically pleasing effect to the user, wherein certain aesthetic features characteristic of the object provide desired carrying functions. Accordingly, the present invention provides a cooler which achieves functionality in its aesthetically pleasing design.

BRIEF SUMMARY OF THE INVENTION

It is an object to improve coolers.

It is another object to improve floating coolers.

It is still another object to provide a cooler which is both functional and aesthetically pleasing to the user.

It is another object to provide a self-stabilizing floating cooler.

Accordingly, one embodiment is directed to floating cooler configured in accordance with a predetermined creature configuration, which includes a buoyant thermally insulated housing, the housing including a bottom portion, a side portion connected to the bottom portion and extending upward therefrom and forming an open enclosure therebetween, wherein the open enclosure defines a cavity and the housing includes an exterior configuration which is generally shaped as a portion of a torso characteristic of the predetermined creature. The cooler further includes a buoyant thermally insulated lid openably connected to the side portion in a manner to generally seal the open enclosure, wherein the lid includes an exterior configuration which is generally shaped as another portion of the torso which is characteristic of the predetermined creature. Further, the cooler includes at least one buoyant appendage extending from the housing in a manner to aid in stabilization of the housing, wherein the appendage includes an exterior configuration which is generally shaped as an appendage characteristic of the predetermined creature.

The appendage can be configured with a receptacle surface for carrying a beverage or the like. The appendage can be thermally insulated and include a removably connectable lid to retain the beverage therein.

Still in another embodiment, the floating cooler can be configured in accordance with a predetermined ornate object, such as a treasure chest or island with ornate objects extending from the chest serving as either stabilizers or drink receptacles.

Other objects and advantages will be readily apparent to those skilled in the art upon viewing the drawings and reading the detailed description hereafter.

BRIEF DESCRIPTION OF THE DRAWINGS

FIG. 2 is a side view of the embodiment of FIG. 1

FIG. 4 is a side view of another embodiment of the present invention.

FIG. 4*a*. is a partial top view of the embodiment of FIG. 4 modified with addition of lids.

DETAILED DESCRIPTION OF THE INVENTION

Figure 1:
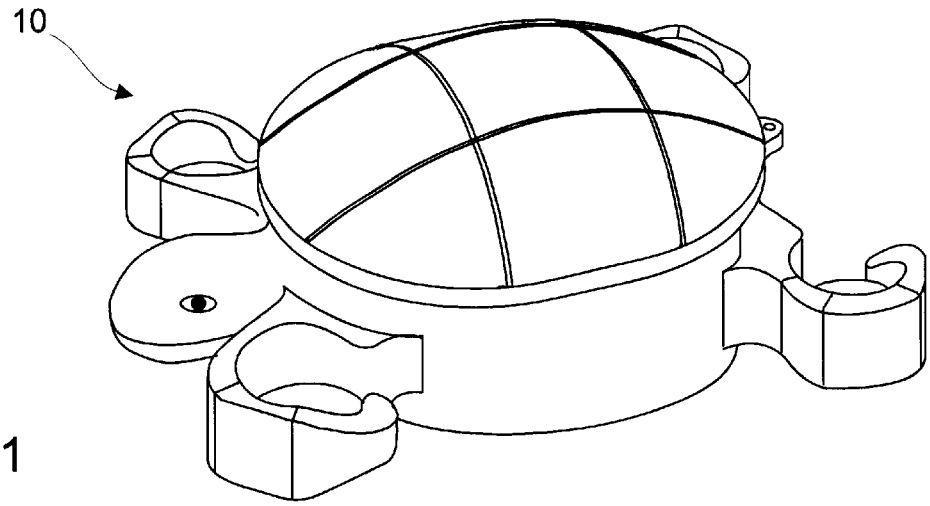
FIG. 1 is a perspective view of an embodiment of the present invention.
Figure 1A:
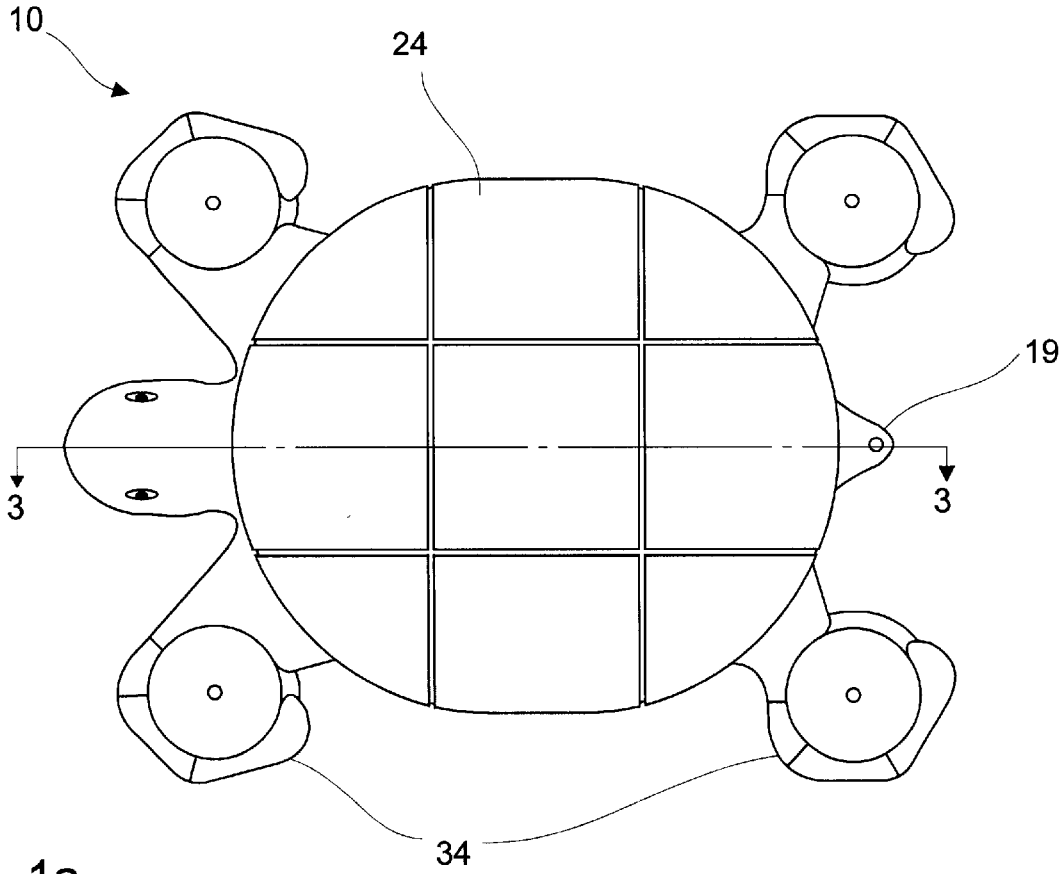
FIG. 1*a*. is a top view of the embodiment of FIG. 1
Figure 1B:
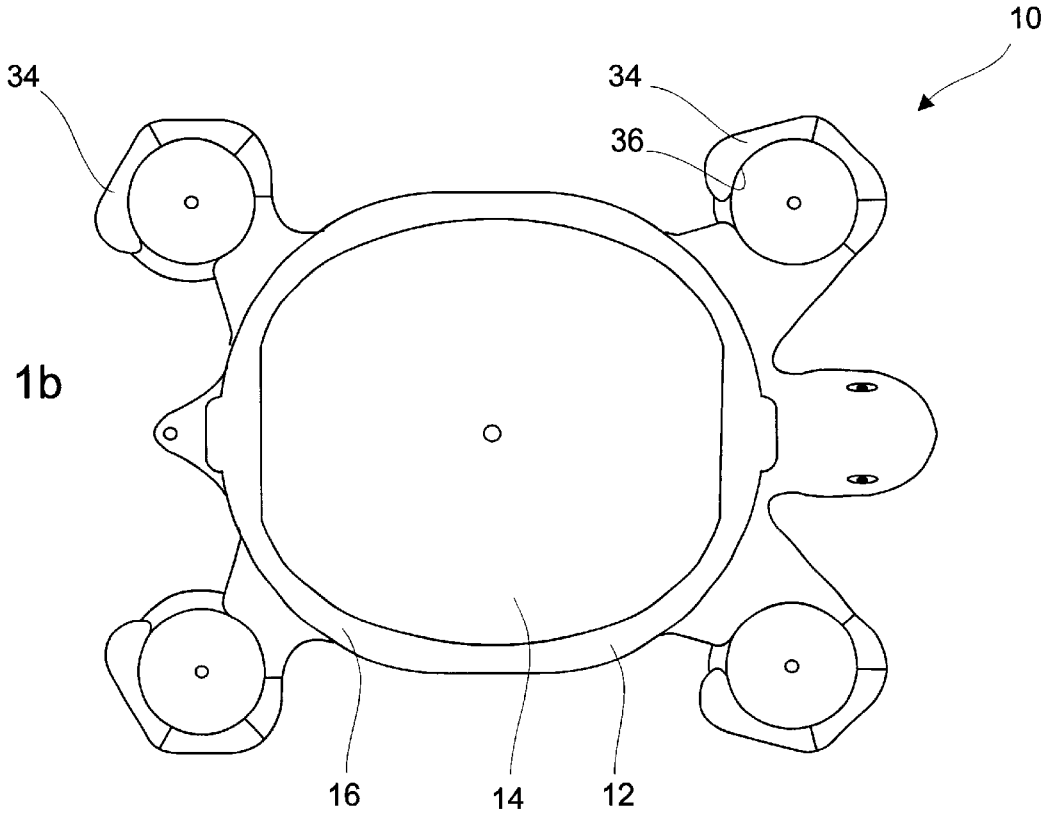
FIG. 1*b*. is a top view of a part the embodiment of FIG. 1
Figure 1C:
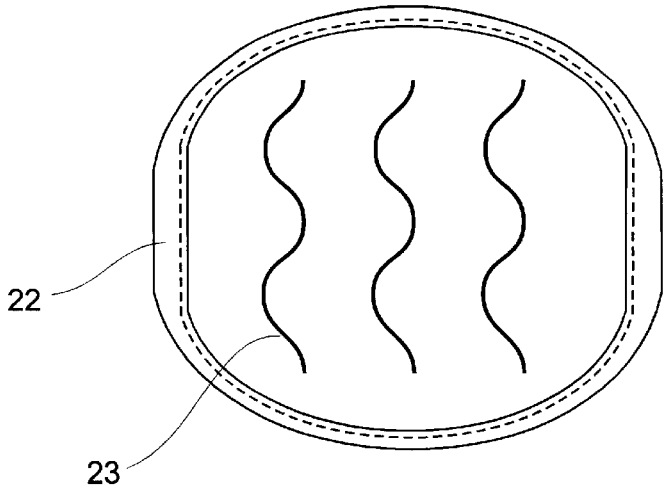
FIG. 1*c*. is a top view of another part the embodiment of FIG. 1
Figure 1D:
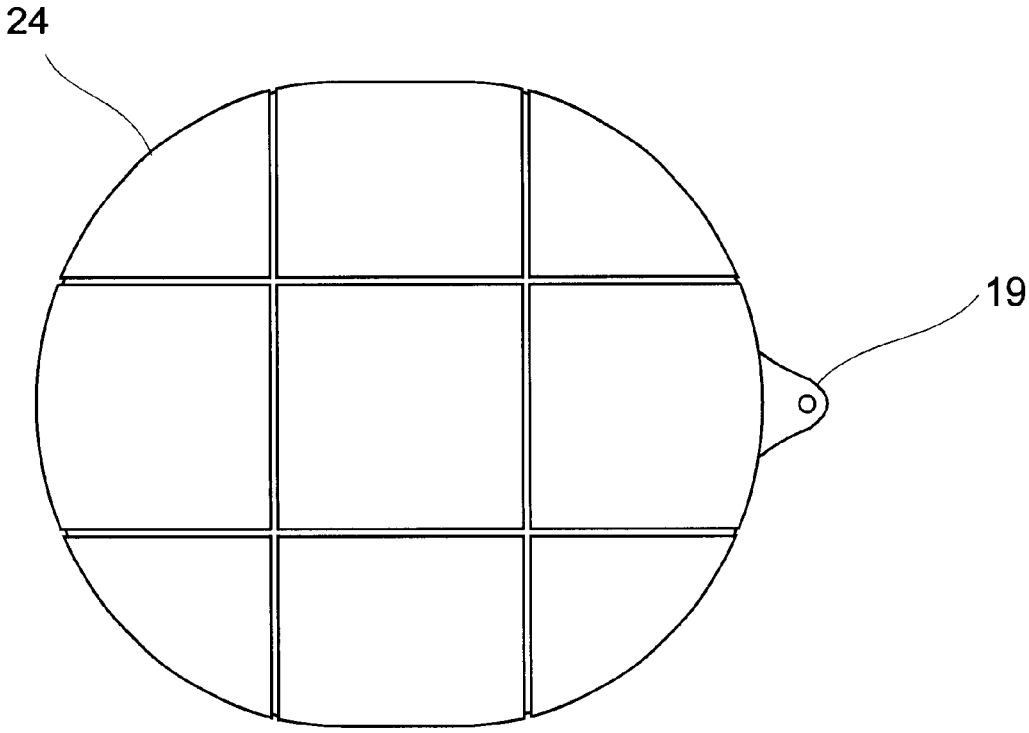
FIG. 1*d*. is a top view of still another part of the embodiment of FIG. 1
Figure 3:
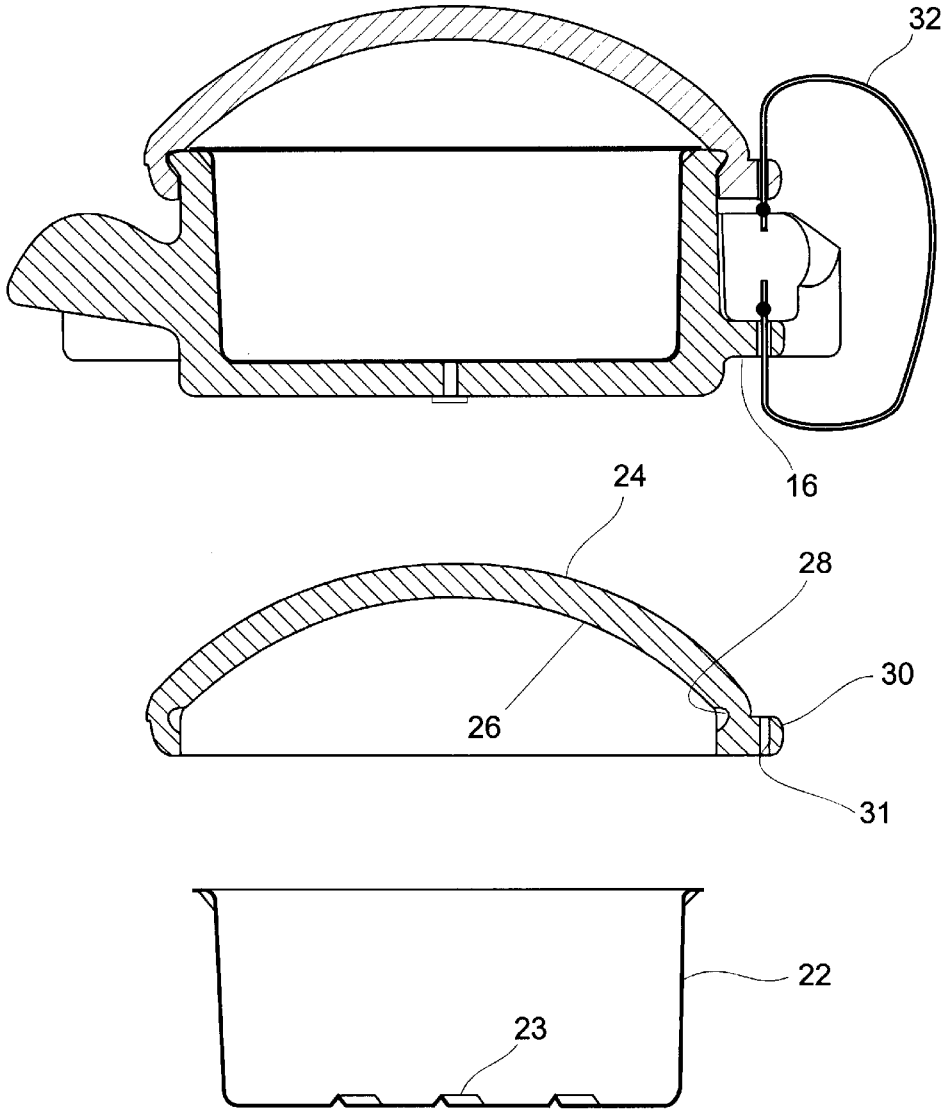
FIG. 3 is a side cross sectional of FIG. 1*a* through line 3—3
Figure 3A:
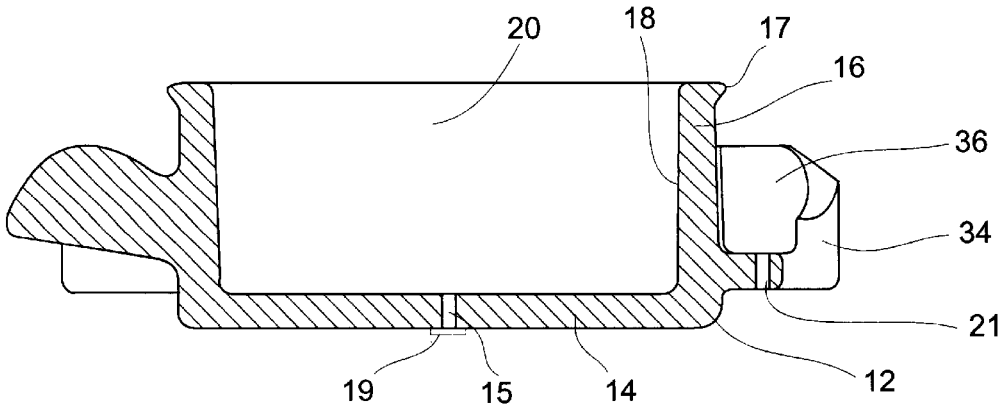
FIG. 3*a* shows the cross sectional view of FIG. 3 in an exploded relation.

Referring now to the drawings, the floating cooler present invention is generally depicted by the numerals 10, 100 and 200. The floating cooler 10, 100, 200 includes a housing 12, 112, 212 can be and preferably is made of a thermally insulated material which is also buoyant. The material may be a foamed plastic such as polyvinyl chloride, polyurethane, polystyrene, polypropylene, cellulose, etc.

The cooler 10 is preferably configured in accordance with a predetermined creature configuration, here shown to be a turtle. The housing 12 includes an exterior configuration which is generally shaped as a portion of a torso which is characteristic of a turtle configuration. The housing 12 includes a bottom portion 14 and side portion 16 connected, preferably integrally, to the bottom portion 14 and extending upward therefrom and forming an open enclosure 18 therebetween. The side portion 16 includes a radially extending upper lip 17. A tail portion 19 radially extends from the side portion 16 and includes an open surface 21 therethrough which receives a part of a rope 32.

Further, the housing 12 includes a drain 15 in the center of the bottom portion 14 which has a removable plug 19 disposed therein. The open enclosure 18 defines a cavity 20. A tray insert 22 which is preferably plastic is removably disposed in the cavity 20 and is configured to fit within the open enclosure 18. The tray insert 22 is preferably large enough to house food and beverages and includes raised ribs 23 to keep certain foods from resting on the bottom.

The cooler further includes a buoyant thermally insulated lid 24 which includes an inner surface 26 defining a retention area 28 which is configured to detectably receive the upper lip 17 of the side portion 16. The lid 22 may be snap-fit to the housing 12 in a manner to generally seal the open enclosure 18. The lid 22 includes an exterior configuration which is generally shaped as a back shell of the turtle. Extending radially from the lid 22 is a tail portion 30 which has an open surface 31 therethrough to receive another portion of the rope 32. The rope 32 can be a connected loop or knotted at to retain the lid 24 to the housing 12.

Alternatively, a rigid bolt with associated nuts or other like members could retain the lid 24 to the housing 12.

The cooler 10 includes four appendages 34, which are preferably buoyant, extending radially from the housing 12. The appendages 34 include an exterior configuration generally shaped with characteristics of the turtle. The appendages 34 are preferably equidistantly spaced from one another and to aid in stabilization of the cooler 10 when placed in the water. The appendages 34 can be configured with a receptacle surface 36 for carrying a beverage or the like. The appendage 34 can be of a thermally insulated material as described to aid in maintaining the beverage temperature.

A removably connectable lid 38 can be pivotally connected to each appendage 34 to retain the beverage therein. The lid can be of a thermally insulated material as described to aid in maintaining the beverage temperature. The exterior of the lid 38 is preferably complimentary configured characteristic of the appendage 34 to which it is connected.

Figure 5:
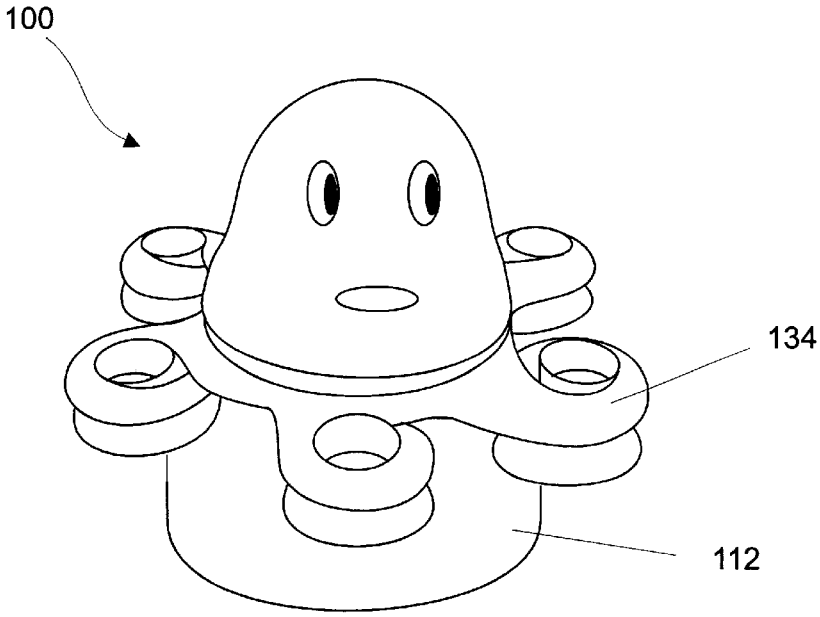
FIG. 5 is a perspective view of another embodiment of the invention.

Further, a head 40 radially extends from the housing 12 preferably at an opposing end to which the tail portion 30 extends. The head 40 is likewise preferably of a buoyant material and configured with an exterior characteristic of a head of the turtle. Also, the cooler 10 can be of a desired buoyancy to floatably support a predetermined weight load. In this regard, the selection and construction of material composition as well as size will affect the weight load capacity. While a specific creature has been described, it is understood that the invention contemplates any cooler formed in any creature and configured as described herein. For example, an octopus 100 as seen in FIGS. 5.

Figure 6:
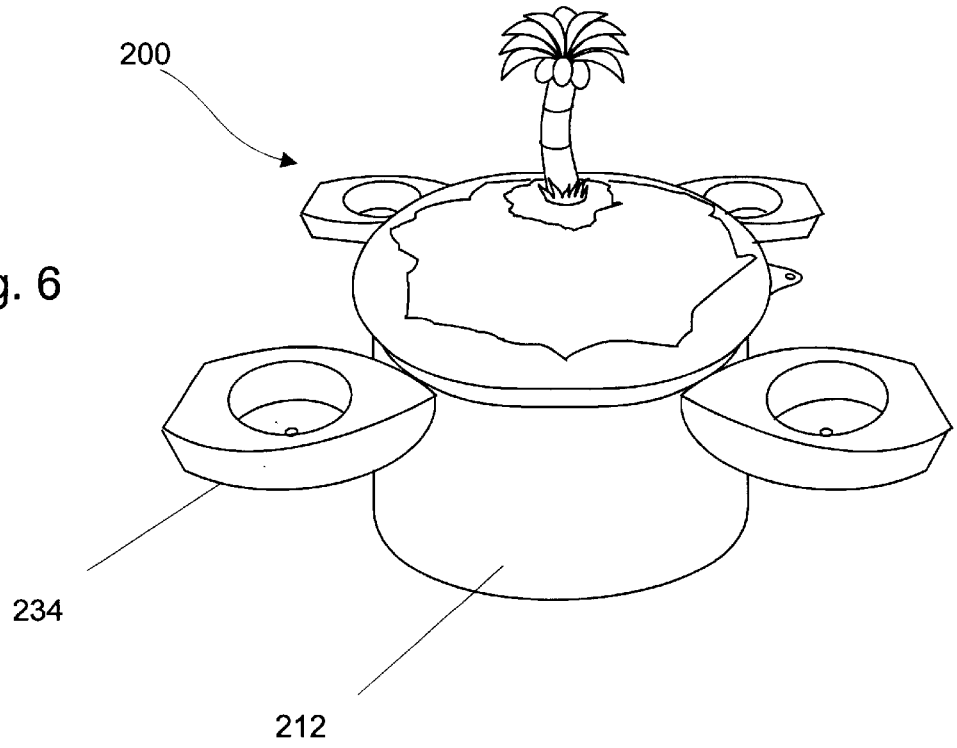
FIG. 6 is a perspective view of still another embodiment of the invention.

Still in another embodiment seen in FIG. 6, the floating cooler can be configured in accordance with a predetermined land mass, such as an island 200 with appendages complimentary characteristic of such objects and extending therefrom serving as either stabilizers or drink receptacles. Here the appendages are shown as boats 234. The invention thus contemplates the concept of tying characteristic of appendages commonly associated with a particular body portion while integrating a utilitarian function thereto.

The above described embodiments are set forth by way of example and are not for the purpose of limiting the present invention. It will be readily apparent to those skilled in the art that obvious modifications, derivations and variations can be made to the embodiments without departing from the scope of the invention. Accordingly, the claims appended hereto should be read in their full scope including any such modifications, derivations and variations.

What is claimed is:

1. A floating cooler configured in accordance with a predetermined animal which includes:

a buoyant, thermally insulated housing, said housing including a bottom portion and a side portion connected to the bottom portion and extending upward therefrom and forming an open surface therebetween, wherein said open enclosure defines a cavity, and wherein said housing has an exterior configuration which is generally shaped as a portion of a body characteristic of the predetermined creature;

a buoyant, thermally insulated lid openly connected to said side portion in a manner to generally seal said cavity, wherein the lid includes an exterior configuration which is generally shaped as another portion of the body which is characteristic of the predetermined creature;

at least one appendage extending from said housing, wherein said appendage includes an exterior configuration which is generally shaped as an appendage characteristic of said predetermined creature and wherein said appendage is sufficiently buoyant to maintain said cooler with a predetermined weight capacity afloat, said appendages being configured with an open receptacle surface for receiving a beverage therein.

2. The floating cooler of claim 1, wherein said appendage is buoyant and aids in stabilization of said housing in water.

3. The floating cooler of claim 1, wherein said appendage is thermally insulated.

4. The floating cooler of claim 1, wherein said housing and said lid each includes a complimentary configured appendage characteristic of said creature and which are operably connected to permit said lid to be disposed from said housing.

5. The floating cooler of claim 1, wherein creature is a turtle.

6. The floating cooler of claim 1, wherein said housing includes a drain and operably associated plug removably disposed therein.

7. The floating cooler of claim 1, which further includes a removable tray insert configured to fit within said open surface.

8. The floating cooler of claim 1, wherein said side portion and said lid are detectably connected in a snap-fit manner.

9. The floating cooler of claim 1, which is further characterized to include a plurality of appendages.

10. The floating cooler of claim 9, wherein said appendages are spatially positioned about said housing to aid in stability thereof.

11. A floating cooler having an exterior shape generally configured as a predetermined creature, which includes:

a buoyant thermally insulated housing, said housing including a bottom portion and a side portion connected to the bottom portion and extending upwards therefrom and forming an open surface therebetween, wherein said open surface defines a cavitity, and wherein said housing includes an exterior configuration which is generally shaped as a portion of a body characteristic of the predetermined ornate object;

a thermally insulated lid openly connected to said side portion in a manner to generally seal said open surface, wherein the lid includes an exterior configuration which is generally shaped as another portion of the body which is characteristic of the predetermined ornate object; and at least one appendage extending from said housing, wherein said appendage includes an exterior configuration which is generally shaped as an appendage characteristic of said predetermined ornate object and wherein said appendage is sufficiently buoyant to maintain said cooler and a predetermined weight capacity afloat, said appendage being configured and having a with and open receptacle surface for receiving a beverage therein, and having a thermally insulated lid pivotally connected to said appendage for retaining the beverage therin.

12. A floating cooler having an exterior shape generally configured as a turtle which includes:

a buoyant thermally insulated housing, said housing including a bottom portion and a side portion connected to the bottom portion and extending upward therefrom and forming an open surface therebetween, wherein said open surface defines a cavity, wherein said cavity includes a drain having a plug operably associated therewith and a removable tray configured to fit within said cavity and wherein said housing has an exterior configuration which is generally shaped as a portion of a body characteristic of the turtle;

a buoyant thermally insulated lid detectably connected to said side portion in a snap-fit manner to generally seal said cavity, wherein the lid includes an exterior configuration which is generally shaped as another portion of the which is characteristic of the turtle;

a plurality of buoyant appendages extending from and partially positioned about said housing, wherein said appendages includes an exterior configuration which is generally shaped as legs characteristic of said turtle and wherein said appendages are sufficiently buoyant to maintain said cooler and a predetermined weight capacity afloat, said appendages being configured with an open receptacle surface for receiving a beverage therein, and having thermally insulated lid pivotally connected to said appendages for retaining the beverage therein.

* * * * *